United States Patent [19]

Assion

[11] 4,219,178

[45] Aug. 26, 1980

[54] STORAGE OR HOLDER DEVICE FOR ELECTRICAL APPLIANCE

[76] Inventor: Norbert Assion, Schwaben-Strasse 91, Schonach, Fed. Rep. of Germany, D7036

[21] Appl. No.: 962,905

[22] Filed: Nov. 22, 1978

[51] Int. Cl.[2] ..... A47F 5/00

[52] U.S. Cl. ..... 248/314; 211/89

[58] Field of Search ..... 248/314, 310, 309, 311.1, 248/315, 316 A; 211/89; 24/263 B

[56] References Cited

U.S. PATENT DOCUMENTS

| | | | |
|---|---|---|---|
| 2,639,880 | 5/1953 | Belloff et al. | 248/314 |
| 2,662,719 | 12/1953 | Hammond | 248/314 |
| 2,845,245 | 7/1958 | Gray et al. | 248/314 |
| 2,872,146 | 2/1959 | Kukla | 248/310 X |
| 3,024,511 | 3/1962 | Schlueter | 24/263 B |
| 3,281,106 | 10/1966 | Bogoanovich | 248/314 |
| 3,964,708 | 6/1976 | Reeves | 248/314 X |
| 4,125,052 | 11/1978 | Thomas | 211/89 X |

FOREIGN PATENT DOCUMENTS

| | | | |
|---|---|---|---|
| 362808 | 12/1931 | United Kingdom | 248/310 |

*Primary Examiner*—J. Franklin Foss

*Attorney, Agent, or Firm*—Burtsell J. Kearns

[57] ABSTRACT

A storage or holder device for an electrical appliance such as a hair dryer adapted for mounting on a wall surface and having an appliance gripping portion for receiving the handle of the appliance and further including selectively releasably detenting means within said holder and operable externally thereof for locking the appliance to the holder.

5 Claims, 5 Drawing Figures

STORAGE OR HOLDER DEVICE FOR ELECTRICAL APPLIANCE

BACKGROUND OF THE INVENTION

The present invention is directed to a support or holder for a portable appliance and in particular for a hand-held electrical hair dryer.

Portable hand-held electrical hair dryers are well known and have gained widespread popularity for both home and professional use in the styling and drying of a person's hair. The hair dryer usually includes a casing having a handle portion and a main housing portion which houses a heater, motor and fan assembly. In use the fan is operated by the motor to draw air into the housing through the heater and then outwardly of the housing through a suitable air discharge orifice.

Although these hair dryers are not large items, they are of a configuration which usually prevents ready storage thereof when not in use. Since the dryer is frequently used it must be readily available to the user and therefore various storage stands or holders have been provided in the past for storing the dryers to accomplish these ends. Further in certain of these stands operation of the dryer is permitted while the dryer is in a stored position so that the user's hands are free for other purposes such as combing or brushing the hair while it is being dried.

In general the prior art holders provide for stands having cradles for receiving the handle or other portion of the hair dryer casing. Although these known stands have proven acceptable for the intended uses, various problems are found in known devices for utilization of the devices both for storing the dryer when not in use yet still maintaining the desirable feature of allowing for operation of the dryer while in the stored position.

It is an object of the present invention to provide a novel holder or support for a portable electrical hair dryer.

Another object is to provide a holder having novel means for maintaining the dryer in stored position and allowing for operation thereof in a plurality of positions in the stored position.

A still further object is to provide a novel holder having novel means for maintaining and locking the hair dryer in stored position which includes means for ready release thereof from the holder.

A further object is to provide a novel holder of relatively few parts thereby allowing for a reduction in manufacturing costs both in labor and material.

SUMMARY OF THE INVENTION

The present invention contemplates a holder for a hair dryer which includes a support member adapted for mounting on a wall surface. An appliance receiving or gripping portion extends from the base of the support and is provided with a grip for receiving and positioning the handle of the dryer. Retractable detent means are provided in the support with actuating means provided for moving the detent means into and out of engagement with the handle to releasably lock and unlock the handle within the gripping portion.

The above and other objects and advantages of the present invention will appear more fully hereinafter from a consideration of the detailed description which follows taken together with the accompanying drawing wherein one embodiment of the invention is illustrated.

DETAILED DESCRIPTION

Figure 1:
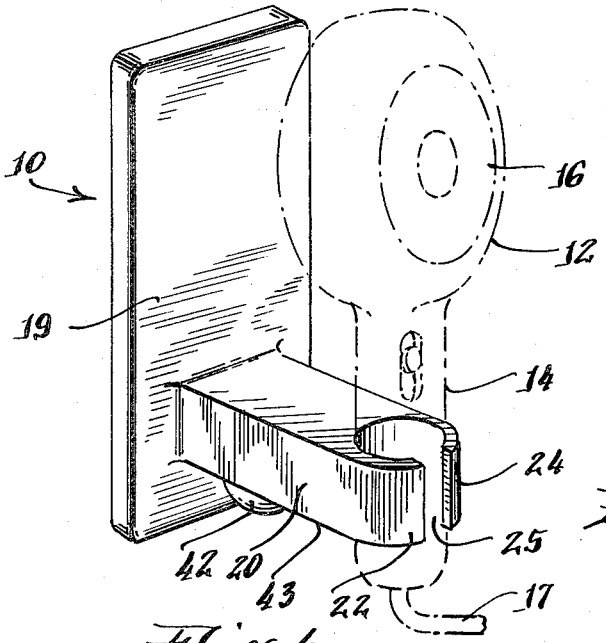
FIG. 1 is a perspective view of a support member incorporating one embodiment of the present invention and illustrates a hair dryer appliance mounted therein.

Referring now to the drawing for a more detailed description of the present invention a holder incorporating one embodiment thereof is generally indicated by the reference numeral 10 in FIG. 1.

A hair dryer 12 is shown in broken line outline form in FIG. 1 and is provided with a handle portion 14 disposed within a tubular shaped receiving or grip portion 15 of holder 10. Hair dryer 12 may be of a usual type which includes within the casing a motor, fan and heater assembly for discharging heated air through discharge orifice 16 when the hair dryer is connected to a suitable electrical outlet via connecting cord 17.

Holder 10 is made of premolded plastic material and includes a rectangular shaped base 19 from which projects a hollow extension portion 20. Grip portion 15 of holder 10 is formed at one end of extension 20 and comprises a pair of arcuate shaped arms 22 and 24 conforming to the outer cylindrical surface of handle 14 of hair dryer 12. An opening or slot 25 is provided in grip portion 15 between the ends of arms 22 and 24 to permit passage therebetween of power connecting cord 17 when dryer 12 is removed or deposited in gripping portion 15.

Figure 2:
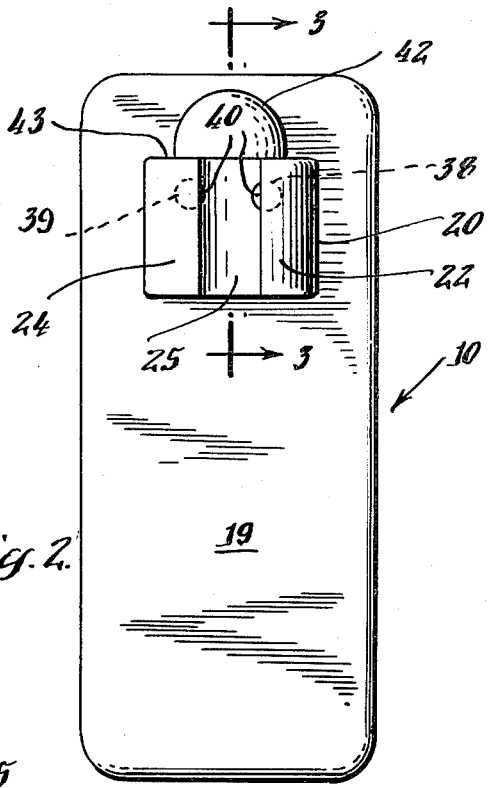
FIG. 2 is a front elevational view of the support of FIG. 1 and shows the support inverted from the position of FIG. 1.

Upper and lower metal wall mounting plates 26 and 27 are secured to the rear of base 19 by means of screws 28 fitted into threaded bosses (not shown) formed in base 19. A plurality of keyhole shaped openings 30 are formed in plates 26 and 27 for permitting the mounting of holder 10 to a wall surface either in a vertical (FIG. 2) or horizontal position in accordance with the needs of the user.

Figure 3:
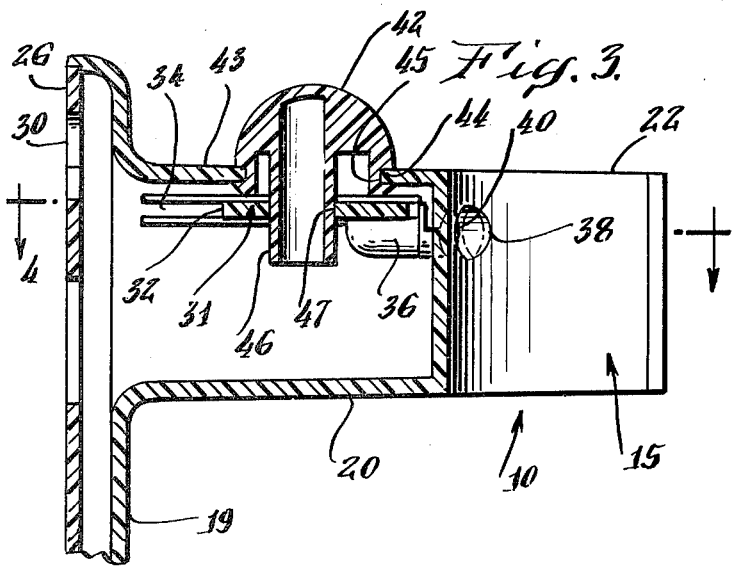
FIG. 3 is a sectional view taken on the line 3—3 of FIG. 2.

As mentioned it is a feature of the present invention to provide novel means for maintaining hair dryer 12 in holder 10. To this end a rectangular slide plate 31 is disposed within extension 20 with the spaced side marginal portions 32 and 33 thereof disposed in spaced guide channels 34-35 provided on the inner wall surface of extension 20. A pair of detent arms 36 and 37 (FIGS. 3 and 4) depend from the end of plate 31 and project through openings 38 and 39 in the walls of gripping portion 15. Resilient detenting pads 40 are secured to the ends of detent arms 36 and 37 to engage the surface of handle 14 of hair dryer 12 to frictionally detent handle 14 within grip portion 15.

Actuating means for moving plate 31 and detent arms 36 and 37 out of engagement with handle 14 include an actuating button 42 rotatably mounted on wall 43 of extension 20 by means of a peripheral recess 44 seated on the surface of wall 43 about opening 45 therein. A drive shaft 46 located eccentrically on button 42 depends therefrom through opening 45 into driving engagement in opening 47 of slide plate 31.

Figure 4:
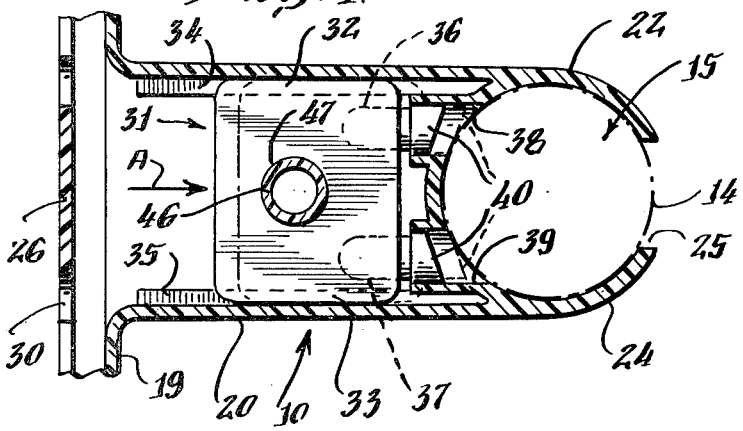
FIG. 4 is a sectional view taken on the line 4—4 of FIG. 4.
Figure 5:
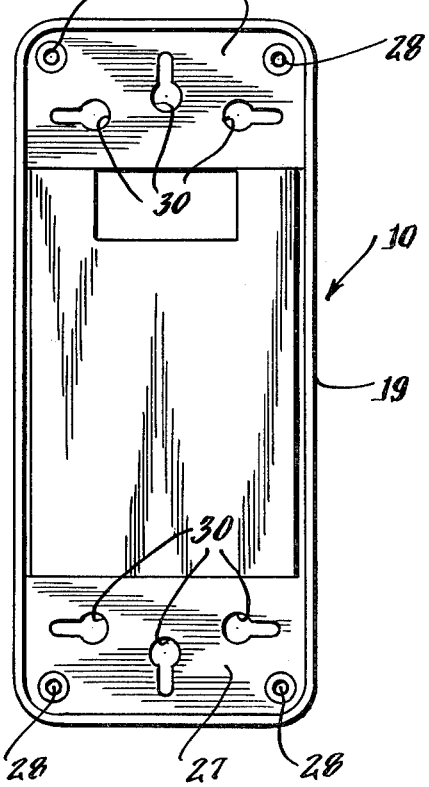
FIG. 5 is a rear elevational view of the support.

In use of holder 10 with holder 10 mounted on a wall surface and with detent arms 36 and 37 in the retracted position shown in FIG. 4, handle 14 of hair dryer 12 is placed in grip position 15 after first passing electrical connecting cord 17 through slot 25. The handle 14 may then be rotated to any desired position in grip 15 to present the heated air orifice 16 of hair dryer 12 at a desired angle by the user.

The user then rotates button 42 to move slide plate 31 in the direction of arrow A in FIG. 4 through drive shaft 46. Plate 31 is moved in guide channels 34-35 together with detent arms 36 and 37 to place pads 40 in detenting frictional engagement with handle 14 locking the latter to holder 10. If desired hair dryer 12 may then be operated through a suitable electrical power connection through cord 17 in mounted position in holder 10. To release handle 14 from grip 15 button 42 is rotated in an opposite direction thereby releasing detent pads 40 from handle 14 whereby hair dryer 10 may be withdrawn from holder 10.

It will be apparent from the foregoing description that the novel holder has many advantages in use. One advantage among others is the fact that the holder may be mounted in varied positions on a wall and the air discharge outlet of the dryer set at a desired angle for operation while in mounted position in gripping portion 15 by rotation of handle 14 and then locking the handle at the desired angular position by means of the described detent means.

Although one embodiment of the present invention has been illustrated and described in detail, it is to be expressly understood that the invention is not limited thereto. Various changes can be made in the design and arrangement of parts without departing from the spirit and scope of the invention as the same will now be understood by those skilled in the art.

What is claimed is:

1. A storage device for a portable electric hair dryer having a casing provided with a handle and an air discharge orifice, said holder comprising (a) a support member provided with a gripping portion for receiving therein the handle of said hair dryer and comprising a base and a casing portion extension projecting from said base, a gripping portion arranged at the free end of said extension and having a wall portion conforming in configuration to the handle of said dryer, (b) detenting means provided in said support member for releasably locking said handle within said gripping portion, (c) said detenting means including a slide plate mounted for movement within said support member extension and having a detent arm connected thereto for movement into and out of engagement with said handle in said gripping portion, (d) said slide plate having spaced marginal portions slidably mounted in guide channels formed in the wall surfaces of said extension, and (e) means mounted on said support and operable for controlling said movement of said slide plate, and including an actuator mounted externally of said extension and a drive shaft extending from said actuator into driving engagement with said slide plate.

2. The device of claim 1 wherein said slide plate has a pair of detent arms extending therefrom into said gripping portion, said actuating means operable to control movement of said detent arms into and out of engagement with said handle.

3. The device of claim 2 wherein said gripping portion includes a pair of gripping arms on the end of said extension and wherein the opposing wall surfaces of said extension arms conform to the configuration of said handle for gripping handle in the detenting position of said detent arms.

4. The device of claim 1 wherein said configuration of said gripping wall portion is of arcuate configuration for receiving a cylindrical handle of said hair dryer, said detenting means adapted to detent said handle at any rotated position thereof within said gripping portion.

5. A storage device for a portable electrical appliance having a cylindrical handle portion, comprising (a) a support member adapted for attachment to a wall surface in any of a plurality of rotated positions relative to said wall, (b) an appliance gripping portion provided on said support member to receive the handle of the appliance, and including an extension projecting from said member and wherein said gripping portion is arranged at the end of said extension, (c) said gripping portion including a pair of arcuate shaped arm members on said extension having opposing surfaces conforming in configuration to the cylindrical surface of said appliance handle, (d) detenting means mounted on said support member for maintaining said handle locked within said gripping portion in any selected rotated position of said handle, or of said support member, (e) said detenting means including a slide plate mounted on said support member and carrying a detenting member, (f) actuating means operable to selectively move said slide plate and detenting member toward or away from said gripping portion respectively into and out of locking engagement with said handle, (g) said support member extension comprising a hollow casing portion projecting from said support member, said slide plate disposed within said hollow casing portion and said detenting member extending through an opening in said casing portion into said gripping portion, and (h) said actuating means including an operating button rotatably mounted on the outer surface of said hollow casing portion and having a drive shaft extending into driving engagement with said slide plate.

* * * * *